United States Patent [19]

Haitmanek

[11] Patent Number: 5,011,430

[45] Date of Patent: Apr. 30, 1991

[54] ELECTRICAL CONNECTOR HAVING CABLE STRAIN RELIEF

[75] Inventor: Louis Haitmanek, Florham Park, N.J.

[73] Assignee: Thomas & Betts Corporation, Bridgewater, N.J.

[21] Appl. No.: 520,697

[22] Filed: May 8, 1990

[51] Int. Cl.[5] ..... H01R 13/58

[52] U.S. Cl. ..... 439/456; 439/470

[58] Field of Search ..... 439/449, 456, 459, 470, 439/471

[56] References Cited

U.S. PATENT DOCUMENTS

| | | | |
|---|---|---|---|
| 3,103,399 | 9/1963 | Martin | 339/17 |
| 3,355,699 | 11/1967 | Oshva | 339/99 |
| 3,813,634 | 5/1974 | Wigby et al. | 339/17 P |
| 3,966,293 | 6/1976 | Mathe et al. | 439/459 |
| 4,006,957 | 2/1977 | Narozny | 339/103 M |
| 4,295,704 | 10/1981 | Narozny et al. | 339/99 R |
| 4,305,635 | 12/1981 | Navarro | 339/99 R |
| 4,460,229 | 7/1984 | Matthews | 339/99 R |
| 4,475,785 | 10/1984 | Müller et al. | 339/75 P |
| 4,718,861 | 1/1988 | Wood | 439/460 |
| 4,925,401 | 5/1990 | Foss et al. | 439/465 |

FOREIGN PATENT DOCUMENTS 0168048 7/1984 European Pat. Off. .

OTHER PUBLICATIONS

IBM Technical Disclosure Bulletin, "Strain Relief Device", vol. 4, No. 5, p. 33, Oct. 1961.

*Primary Examiner*—Gary F. Paumen

*Attorney, Agent, or Firm*—Robert M. Rodrick; Salvatore J. Abbruzzese

[57] ABSTRACT

An electrical connector assembly for terminating flat multiconductor ribbon cable is disclosed. The connector assembly includes a base supporting plural insulation-piercing contacts in a pre-determined array. A cover, positioned over the base, is movable with respect thereto to effect cable termination to the contacts. Cable strain relief is provided by spring clips which urge an extent of cable against a side wall of the cover.

5 Claims, 2 Drawing Sheets

ELECTRICAL CONNECTOR HAVING CABLE STRAIN RELIEF

FIELD OF THE INVENTION

This invention relates generally to electrical connectors for terminating flat multiconductor ribbon cable. More particularly, the present invention relates to an insulation displacing electrical connector which terminates an electrical cable upon engagement of a connector base with a connector cover, and which provides for cable strain relief in conjunction with the connector cover.

BACKGROUND OF THE INVENTION

Electrical connectors used to terminate multiconductor flat ribbon cable have long been known. Connectors of this type typically include a connector housing comprising a base supporting plural insulation displacing electrical contacts and a cover positionable over the base. The cover and the base define a recess which receives the ribbon cable. An appropriate tool may be used to displace the base and the cover towards one another to force the insulation displacing contacts into electrical engagement with the conductors of the ribbon cable.

The terminated connector may now be connected to an appropriate electronic device for subsequent use. Examples of connectors such as these are shown in commonly assigned U.S. Pat. Nos. 4,295,704; 4,305,635 and 4,460,229. As the ribbon cable is held to the connector by means of the insulation displacing connection of the connector contacts to the conductors of the multiconductor cable, the interface between the contacts and the conductors is subject to the adverse effects of cable strain, that is, stress placed on the connection by movement of the cable in a longitudinal direction.

Insulation displacing connectors have addressed the need for cable strain relief by providing separable strain relief elements attachable to the connector housing to clamp a portion of the flat cable between the strain relief member and the cover, thereby relieving the stress on the connection of the conductors to the contacts. An example of a strain relief connector of this type is shown in commonly assigned U.S. Pat. No. 4,006,957. While adequately serving the strain relief function, connectors of this type must include an additional structural component by way of a strain relief member typically mounted to the upper surface of the connector cover. This greatly increases the height of the connector as the strain relief member and the looped cable must be accommodated above the cover. Thus increased spacing is necessary between vertically adjacent connectors. Also, the use of associated hardware, such as a connector ejector mechanism, is greatly inhibited. An additional limitation of strain relief devices which attach to the upper cover surface is that strain relief is provided only for cable passing through the connector in one direction. Thus, strain relief is not adequately provided for connectors which terminate cable at an intermediate location therealong in "daisy-chain" fashion.

It is therefore desirable to construct a connector assembly which will provide for cable strain relief without the need for additional components secured to the upper surface of the cover. Further, it is desirable to provide a strain relief electrical connector which permits daisy-chain connection to an intermediate location of an electrical cable.

SUMMARY OF THE INVENTION

It is therefore an object of the present invention to provide an electrical connector assembly which terminates a multiconductor ribbon cable and which provides for strain relief of the cable.

It is a further object of the present invention to provide an electrical connector assembly which includes a cable strain relief device securable to the cover along the longitudinal sides thereof without need to increase the height of the connector.

It is a still further object of the present invention to provide an electrical connector assembly which permits the strain relief termination of a transverse extent of an elongate multiconductor ribbon cable with strain relief being provided on both sides of the termination extent.

In the efficient attainment of these and other objects, the present invention provides an electrical connector assembly for terminating a transverse termination extent of an elongate multiconductor ribbon cable. The assembly includes a connector base having opposed upper and lower surfaces. A plurality of insulation piercing contacts are supported in the base, with the insulation displacing extents extending above the upper surface of the base. A cover is movably supported over the base, and includes a pair of longitudinal side walls and a lower cable engagement wall which affects movement of the cable into insulation piercing connection with the contacts. Clip means is supported by the cover adjacent a side wall of the cover. The clip means secures a transverse extent of the cable spaced from the termination extent to the side wall of the cover to provide cable strain relief thereat.

As shown by way of the preferred embodiment herein, the connector assembly further includes clip means in the form of a pair of clips, each clip supporting a transverse extent of cable against respective opposed longitudinal side walls of the cover so that an intermediate location of the cable may be terminated by the connector assembly, and strain relief is provided on either side of the terminated extent.

DETAILED DESCRIPTION OF THE PREFERRED EMBODIMENT

Figure 1:
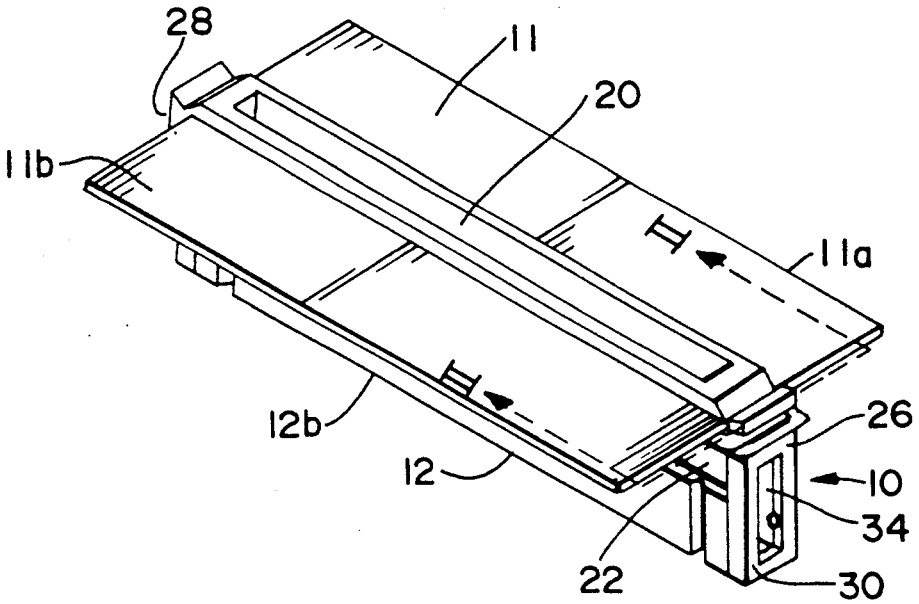
FIG. 1 is a perspective showing of the connector assembly of the present invention terminating an extent of multiconductor ribbon cable.
Figure 2:
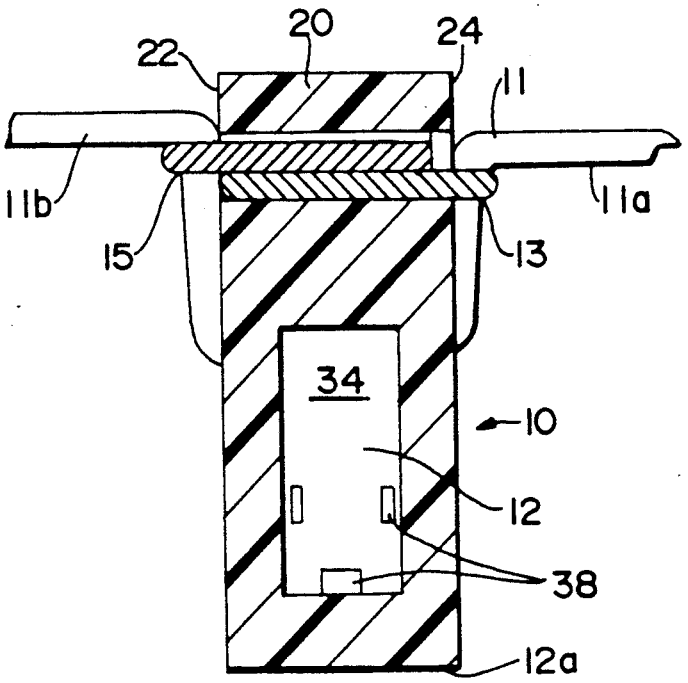
FIG. 2 is a vertical section of the cable and connector assembly of FIG. 1 taken through the lines II—II thereof.
Figure 3:
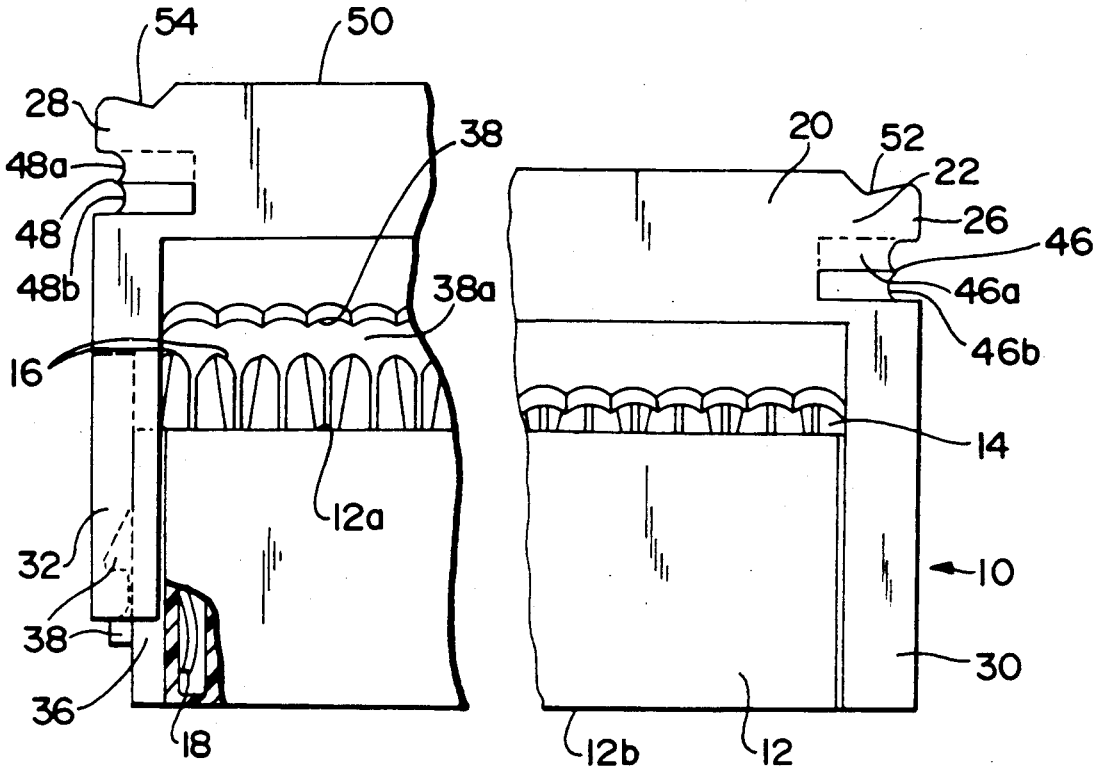
FIG. 3 is a split plan view showing the connector assembly of FIG. 1 in both the open and closed position.

Referring to FIGS. 1 through 3, electrical connection assembly 10 of the present invention is used to terminate flat multiconductor ribbon cable 11. Connector assembly 10 includes an elongate base 12 comprised of electrically insulative plastic. As shown in FIG. 3, base 12 supports a plurality of electrical contacts 14 in fixed position therein. Contacts 14 are disposed in plural longitudinally extending rows, and have upper insulation piercing ends 16 which extend above upper surface 12*a* of base 12. Contacts 14 have lower termination ends 18 adjacent lower base surface 12*b*. Termination ends 18 and lower surface 12*b* of base 12 are designed for interconnection with a mating connector assembly (not shown).

Insulation piercing ends 16 of contacts 14 are of conventional construction and are of the type used to electrically terminate conductors of multiconductor ribbon cable 11. Contacts of this type are widely used in electrical connectors. Also as conventionally known, contacts 14 are arranged so that each insulation piercing end 16 of contacts 14 is positioned uniquely with one conductor of multiconductor ribbon cable 11.

Cover 20 is an elongate plastic member extending longitudinally with base 12. Cover 20 includes a pair of opposed longitudinal side walls 22 and 24 and transverse end walls 26 and 28. Cover 20 includes depending latch arms 30 and 32 extending from transverse end walls 26 and 28 respectively. Latch arms 30 and 32 engage with transverse ends 34 and 36 of base 12 in latching fashion. Transverse ends 34 and 36 include latch elements 38 which provide for dual-position latching of cover 20 to base 12. Cover 20 has a continuous undersurface 38 which may be ribbed to engage multiconductor ribbon cable 11 as is known in the insulation-piercing connector art. Movement of cover 20 from a first latched position shown in the left hand drawing of FIG. 3, to a second latched position shown in the right hand drawing of FIG. 3 effects insulation piercing connection of multiconductor ribbon cable 11 to the insulation piercing ends 16 of contacts 14. Such movement of cover 20 toward base 12 may be accomplished by a suitable tool (not shown).

Connection of contacts 14 to ribbon cable 11 is accomplished in a region 38*a* defined between undersurface 38 of cover 20, and upper surface 12*a* of base 12. Such connection is accomplished along a transverse extent of ribbon cable 11, intermediate the ends thereof. Termination in this manner allows cable 11 to be "daisy-chain" connected to additional connectors along its longitudinal extent. Accordingly, as is particularly shown in FIGS. 2 and 3, ribbon cable 11 will extend beyond both longitudinal side walls 22 and 24 of cover 20.

In order to provide strain relief for the connection of ribbon cable 11 to contacts 14, the present invention provides a strain relief mechanism in the form of clip means attachable to cover 20.

Figure 4:
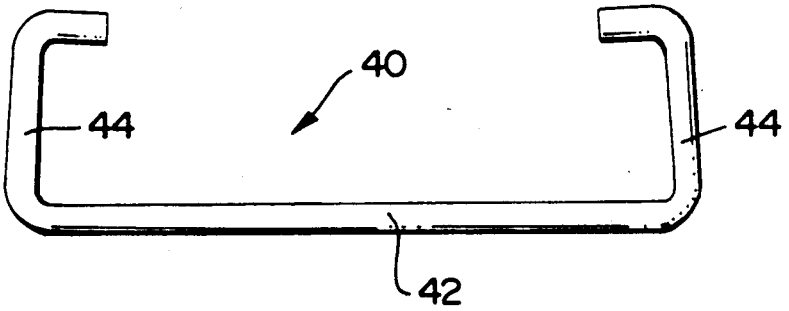
FIG. 4 shows a strain relief clip used in combination with the connector assembly of FIG. 1.
Figure 5:
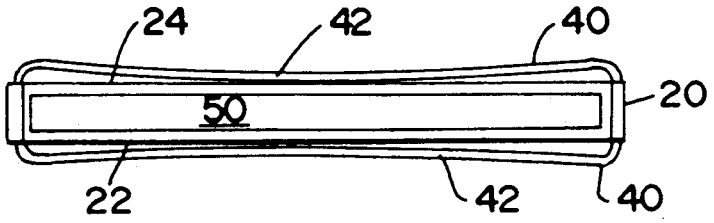
FIG. 5, is a top plan view of the cover of the connector assembly of FIG. 1.

Referring additionally to FIGS. 4 and 5, the present invention provides a pair of metallic spring clips 40, one of which is shown in FIG. 4. Spring clip 40 is an elongate member having a longitudinally extending leaf spring portion 42 and opposed transverse securement extents 44 at each end thereof. Spring clip 40 is attachable adjacent each longitudinal side wall 2 and 24 of cover 20, the leaf spring portion 42 being springbiasingly supported against or in close proximity to longitudinal side walls 22 and 24.

Transverse end walls 26 and 28 include a recessed undulated portions 46 and 48 respectively, adjacent upper surface 50 of cover 20. Recessed undulated portions 46 and 48 support transverse securement portions 44 of spring clip 40 to secure the spring clip to cover 20. As shown in FIG. 3, each recessed undulated portion 46, 48 includes a pair of upper and lower nests 46*a*, 46*b* and 48*a*, 48*b* respectively, which accommodate the pair of spring clips 40, one above another, as shown in FIG. 2.

As particularly shown in FIG. 5, leaf spring portion 42 of clips 40 is centrally bowed to bear against (or in close proximity to) each of longitudinal side walls 22 and 24 of cover 20.

Having described the structure of the present invention, its operation may now be shown.

Referring to FIGS. 1 and 2, connector assembly 10 is connected to an intermediate transverse portion of ribbon cable 11 in a manner conventionally known in the art. Cable 11 is typically placed over upper surface 12*a* of base 12, and cover 20 is placed thereover in first latched position on base 12. It is also contemplated that cover 20 may be prelatched to base 12 and then cable 11 inserted in region 38*a* defined therebetween. With conventional crimping tools, cover 20 is brought down onto base 12 to move cover 20 to its second latched position to effects insulation piercing termination of cable 11 to the conductors 14 supported in base 12. Electrical connection is thereby established between ribbon cable 11 and connector assembly 10.

In order to provide strain relief for cable 11, spring clips 40 are employed. Each extending portion of cable 11*a* and 11*b* on either side of connector assembly 10 may be manually held in a vertical position so that one spring clip 40 may be inserted against each longitudinal side wall 22, 24 of cover 20. Leaf spring portion 42 of each spring clip 40 bears against a transverse portion 13, 15 of cable 11 to force it against the respective longitudinal side wall 22, 24 of cover 20. Thus, transverse portions 13 and 15 of cable 11 on either side of the terminated transverse extent are held against the longitudinal side walls 22 and 24 of cover 20 to provide strain relief for cable 11. As spring clips 40 bear against longitudinal side walls 22 and 24 of cover 20 rather than the upper surface 50 thereof, the height of connection assembly 10 is not increased. Portions 11*a* and 11*b* of cable 11 extend nearly horizontally outward from connection assembly 10. This permits use of a conventional latching and ejector mechanism (not shown) which may engage notches 52 and 54 on opposed longitudinal ends of upper surface 50 of cover 20.

The present invention provides for the termination of an intermediate transverse extent of ribbon cable 11 with strain relief being provided on each spaced longitudinal side of this terminated extent. Thus, cable 11 may be "daisy-chain" connected to several longitudinally spaced connectors. It is, however, contemplated that present invention may be employed in the termination of one end of cable 11, with strain relief being provided on only one side thereof. Also, each spring clip 40 functions independently so that one clip may be removed without disturbing the opposite clip.

Various changes to the foregoing described and shown structures would now be evident to those skilled in the art. Accordingly, the particularly disclosed scope of the invention is set forth in the following claims.

I claim:

1. An electrical connector assembly for terminating a transverse termination extent of an elongate multiconductor ribbon cable, said assembly comprising:

an elongate connector base having opposed upper and lower surfaces;

a plurality of contacts fixedly positioned in said base in a pre-determined pattern, said contacts having insulation-piercing extents extending above said upper surface of said base and connection extents adjacent said lower surface of said base;

an elongate cover movably supported over said base having a pair of longitudinal side walls, transverse end walls, and a lower cable engagement wall extending therebetween for affecting movement of said transverse termination extent of said cable into insulation-piercing connection with said contacts; and an elongate leaf spring clip supported by and separate from said cover along a side wall of said pair and extending longitudinally therealong for supporting a further transverse extent of said cable longitudinally spaced from said transverse termination extent, said clip being spring-biased toward said side wall to secure said further transverse extent of said cable thereagainst in strain-relief fashion.

2. A connector assembly of claim 1 wherein said clip includes a transverse securement element at each end thereof, said securement elements being secured to said transverse end walls of said cover to support said clip adjacent to said side wall of said cover.

3. A connector assembly of claim 2 wherein said transverse termination extent of said cable is located intermediate the longitudinal ends thereof.

4. A connector assembly of claim 3 including a pair of said clips, one of said clips supported adjacent one of said longitudinal side walls of said cover, and the other clip of said pair supported adjacent the other longitudinal side wall of said cover.

5. A connector assembly of claim 4 wherein said one clip supports said further transverse extent of said cable against said one longitudinal side wall of said cover and said other clip support an additional transverse extent of said cable against said other longitudinal side wall of said cover.

* * * * *

UNITED STATES PATENT AND TRADEMARK OFFICE
Certificate

Patent No. 5,011,430 Patented: April 30, 1991

On petition requesting issuance of a certificate for correction of inventorship pursuant to 35 U.S.C. 256, it has been found that the above-identified patent, through error and without any deceptive intent, improperly sets forth the inventorship. Accordingly, it is hereby certified that the correct inventorship of this patent is: Louis Haitmanek and Wayne Wellinsky.

Signed and Sealed this Tenth Day of September, 1991.

LARRY I. SCHWARTZ

*Supervisory Patent Examiner*
*Art Unit 322*